US010801702B1

(12) United States Patent
Thurman

(10) Patent No.: US 10,801,702 B1
(45) **Date of Patent: *Oct. 13, 2020**

(54) LIGHT FIXTURE COMPRISING CARBON MATERIALS AND METHODS THEREFOR

(71) Applicant: Rick D. Thurman, Pleasant Grove, UT (US)

(72) Inventor: Rick D. Thurman, Pleasant Grove, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/563,005

(22) Filed: Sep. 6, 2019

Related U.S. Application Data

(63) Continuation-in-part of application No. 15/841,693, filed on Dec. 14, 2017, now Pat. No. 10,408,431.
(Continued)

(51) Int. Cl.

| | |
|---|---|
| ***F21V 17/00*** | (2006.01) |
| ***F21V 15/01*** | (2006.01) |
| ***F21V 19/00*** | (2006.01) |
| ***F21S 8/08*** | (2006.01) |
| *F21Y 115/10* | (2016.01) |
| *F21Y 105/16* | (2016.01) |
| *F21V 29/503* | (2015.01) |
| *F21V 17/12* | (2006.01) |

(Continued)

(52) U.S. Cl.
CPC ..... *F21V 15/01* (2013.01); *F21S 8/086* (2013.01); *F21V 19/0055* (2013.01); *F21V 17/12* (2013.01); *F21V 23/001* (2013.01); *F21V 29/503* (2015.01); *F21V 29/87* (2015.01); *F21W 2131/103* (2013.01); *F21W 2131/40* (2013.01); *F21Y 2105/16* (2016.08); *F21Y 2115/10* (2016.08)

(58) Field of Classification Search
CPC ..... F21S 48/1208; F21V 17/107; F21V 17/00
USPC ..... 362/375
See application file for complete search history.

(56) References Cited

U.S. PATENT DOCUMENTS 7,670,021 B2 3/2010 Chou
8,066,407 B2 * 11/2011 Remus ..... F21S 8/06 362/147

(Continued)

OTHER PUBLICATIONS

U.S. Appl. No. 15/841,693, Sep. 28, 2018, Office Action.
U.S. Appl. No. 15/841,693, Apr. 1, 2019, Office Action.
U.S. Appl. No. 15/841,693, Apr. 30, 2019, Notice of Allowance.

*Primary Examiner* — Ahshik Kim
(74) *Attorney, Agent, or Firm* — Workman Nydegger

(57) ABSTRACT

A light fixture may include a dome member including exterior and interior surfaces, and a panel positioned adjacent to the interior surface of the dome member. The panel may comprise carbon fiber. The panel may provide a mounting surface to which circuit boards including LEDs are mountable. The panel may include raised portions and recessed portions, which provide a mounting surface to which the circuit board(s) may be mounted. The circuit board may span the distance between adjacent raised portions of the panel, spanning a corresponding recess. Such a recess may provide for an air gap for improved air circulation. The fixtures may be used in corrosive environments, to provide a useful life that is extended relative to what the lifespan would be if the panel were not carbon fiber. Examples of corrosive environments include livestock facilities, enclosed agricultural facilities, coastal highways, sewage and other water treatment plants, etc.

11 Claims, 10 Drawing Sheets

Related U.S. Application Data

(60) Provisional application No. 62/435,196, filed on Dec. 16, 2016.

(51) Int. Cl.

| | |
|---|---|
| *F21W 131/40* | (2006.01) |
| *F21W 131/103* | (2006.01) |
| *F21V 29/87* | (2015.01) |
| *F21V 23/00* | (2015.01) |

(56) References Cited

U.S. PATENT DOCUMENTS

| | | | | |
|---|---|---|---|---|
| 10,408,431 | B1 | 9/2019 | Thurman | |
| 2008/0018256 | A1 | 1/2008 | Snyder | |
| 2010/0110699 | A1 | 5/2010 | Chou | |
| 2010/0128473 | A1 | 5/2010 | Parra | |
| 2011/0273881 | A1 | 11/2011 | Domagala | |
| 2012/0206926 | A9 | 8/2012 | Chou | |
| 2012/0218764 | A1 | 8/2012 | Williamson | |
| 2013/0120963 | A1 | 5/2013 | Holland | |
| 2014/0293590 | A1 | 10/2014 | Pathy | |
| 2015/0313181 | A1* | 11/2015 | Burroughs | F21V 17/007 119/753 |
| 2016/0025277 | A1 | 1/2016 | Spinelli | |
| 2016/0033111 | A1 | 2/2016 | Thraen | |

* cited by examiner

LIGHT FIXTURE COMPRISING CARBON MATERIALS AND METHODS THEREFOR

CROSS-REFERENCE TO RELATED APPLICATIONS

The present application is a continuation-in-part under 35 U.S.C 120 of U.S. patent application Ser. No. 15/841,693 entitled "Light Fixture Comprising Carbon Materials", filed Dec. 14, 2017, which claims the benefit under 35 U.S.C. 119(e) of U.S. Patent Application No. 62/435,196, entitled "Light Fixture Comprising Carbon Materials", filed Dec. 16, 2016, the disclosure of each of which is herein incorporated by reference in its entirety.

BACKGROUND OF THE INVENTION

1. The Field of the Invention

The invention relates to lighting fixtures, e.g., as used in various applications.

2. The Relevant Technology

A wide variety of lighting fixtures are commercially available. For example, incandescent, fluorescent, metal halide, and other technologies have been used to meet indoor and outdoor lighting needs. Even with the wide variety of available fixtures from which to choose, particular problems continue to exist, particularly within various specific application fields. For example, within dairy barns, typically employed lighting fixtures tend to degrade (or "rot") relatively quickly due to the elevated concentration of reactive constituents released from the cows. For example, significant quantities of methane, hydrogen sulfide, and other reactive constituents are generated by cows (e.g., through belching and flatulence) or other livestock housed within the barn or other building. The typical fluorescent or other lighting fixtures routinely employed in lighting such a barn or other building have been observed to degrade or rot, so that they must be replaced within a relatively short 2-3 year period.

Similar problems exist in other fields of use where the environment in which the lighting fixture is placed is similarly corrosive. For example, water treatment and sewage treatment plants often include similarly corrosive environments where methane, hydrogen sulfide, or other corrosive, reactive constituents are present. Municipal and highway lighting in high salinity environments (e.g., coastal highways, such as HWY 101 in California) exhibit similar problems with respect to deterioration of the light fixtures and poles on which they are mounted, as both such fixtures and poles are typically formed of conventional metal materials (e.g., galvanized metal poles, with conventional steel or other metals, plastics, etc. used for the actual light fixture. Similar accelerated degradation of light fixture and supporting pole structures also occurs even in environments away from the ocean or other high salinity environment, e.g., where heavy salting of a roadway may occur during winter, etc. Another environment where such accelerated degradation may occur is in interior agricultural environments, e.g., where "grow lights" are used to grow plants indoors, e.g., in a closed "close quarters" type environment, where humidity is often elevated, and where salts such as calcium or other salts tend to build up deposits or "scale" on existing light fixtures. Such salts may similarly cause corrosion, as described above in the context of dairy barns. Within any of such, or other similar corrosive environments, accelerated degradation of the fixtures and associated supporting structure continues to be a problem.

Such regular replacement of lighting fixtures is a problem that has not yet been adequately addressed within the field. It would be an advancement in the art to provide lighting fixtures that could produce desired lighting characteristics, and that would be resistant to degradation and rotting that typically occurs.

BRIEF SUMMARY

The disclosure relates to light fixtures that may include a dome member including an exterior surface and an interior surface, and a panel positioned adjacent to (e.g., attached to) the interior surface of the dome member. The panel may comprise carbon (e.g., carbon fiber, amorphous carbon, or other carbon material providing relatively high thermal conductivity). The panel may provide a mounting surface to which circuit boards including one or more LEDs (e.g., or other high efficiency light source) are mountable. For example, the panel may include raised portions and recessed portions. The raised portions may provide a mounting surface to which the circuit board(s) may be mounted. The circuit board may span the distance between adjacent raised portions of the panel, spanning a corresponding recess. Such a recess may provide for a gap (e.g., an air gap) on the underside of the circuit board, for improved air circulation (facilitating convection cooling). Such a gap may also facilitate easy electrical connection of electrical power to each circuit board.

Because the panel comprises carbon fiber or another carbon material providing relatively high thermal conductivity, heat generated by the LEDs within the circuit board may be quickly and efficiently conducted away from the circuit board and LEDs, into the relatively large panel, away from the circuit boards, e.g., through the raised portions, into the remaining peripheral portions of the panel for eventual dissipation into the surrounding air.

Another embodiment is directed to an LED light fixture including a dome member including an exterior surface and an interior surface, and a panel attached to the interior surface of the dome member, wherein the panel comprises carbon fiber. The panel includes raised portions and recessed portions between adjacent raised portions, the raised portions including a mounting surface. The light fixture further includes at least one circuit board mounted to the mounting surfaces so that the circuit board spans between the adjacent raised portions of the panel. The circuit board(s) may include one or more LEDs.

The present disclosure also relates to methods of manufacture and methods of use. For example, any of the disclosed light fixtures may be manufactured by providing the individual components, and assembling them together. As described herein, such assembly may include providing a sealed, UL approved (or UL approvable) space between the dome member and the panel where an electrical connection may be made (e.g., wire nuts may be used to attach power wiring to the wiring of the light fixture within this UL approved or approvable space). Such a UL approved or approvable space eliminates any need for a separate electrical junction box for housing such electrical connections.

Another embodiment of the present disclosure relates to a method by which a light fixture as described herein may be retrofitted into an existing light fixture, the light source of which is to be replaced with the present light sources. For example, many existing light fixtures installed in various environments could be retrofitted, with the presently disclosed high efficiency LED light sources. An example of such is the bell-shaped light fixtures prevalent in various forums, such as arenas (indoor and outdoor), gymnasiums, and other large venues. One such method may include removing the old light source (non-LED, such as incandescent, fluorescent, halogen, sodium vapor, or other) from such a bell-shaped light fixture, and positioning the LED light fixture of the present invention into the void left behind after removal of the old light source (e.g., halogen, incandescent, or other low efficiency, non-LED light source). The dome member of the replacement light fixture may include an edge portion (e.g., which may be downwardly curved or sloped), and a central portion surrounded by the edge portion that is flat (e.g., on top). Such a configuration may easily fit up into the existing bell-shaped light fixture (e.g., the diameters may be essentially the same, allowing a flush insertion of the dome member up into the bell shaped housing).

Another method may involve installing and/or using light fixtures as described herein, in which at least a portion of the housing of the light fixture comprises carbon (e.g., carbon fiber), in a dairy barn, or similar animal husbandry environment. In such environments, use of such a carbon fiber or other carbon housing may be particularly beneficial as the carbon material is relatively inert to the corrosive gases and/or other materials typically present within such an environment, and which gases and/or other materials lead to accelerated degradation of conventional lighting fixtures. Such a method may thus provide an extended useful lifetime for the lighting fixture, as compared to conventional fixtures traditionally employed in such environments (far longer than the typical 2-3 years provided by conventional fixtures in such corrosive environments). For example, the fixture may have a useful lifetime in such an environment of at least 5 years, at least 10 years, or even more typically at least 15 years, at least 20 years, at least 25 years, or at least 30 years, even in the above described environments, including chronic exposure to corrosive gases and/or other materials.

These and other advantages and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings.

DETAILED DESCRIPTION OF DISCLOSED EMBODIMENTS

I. Introduction

Figure 1:
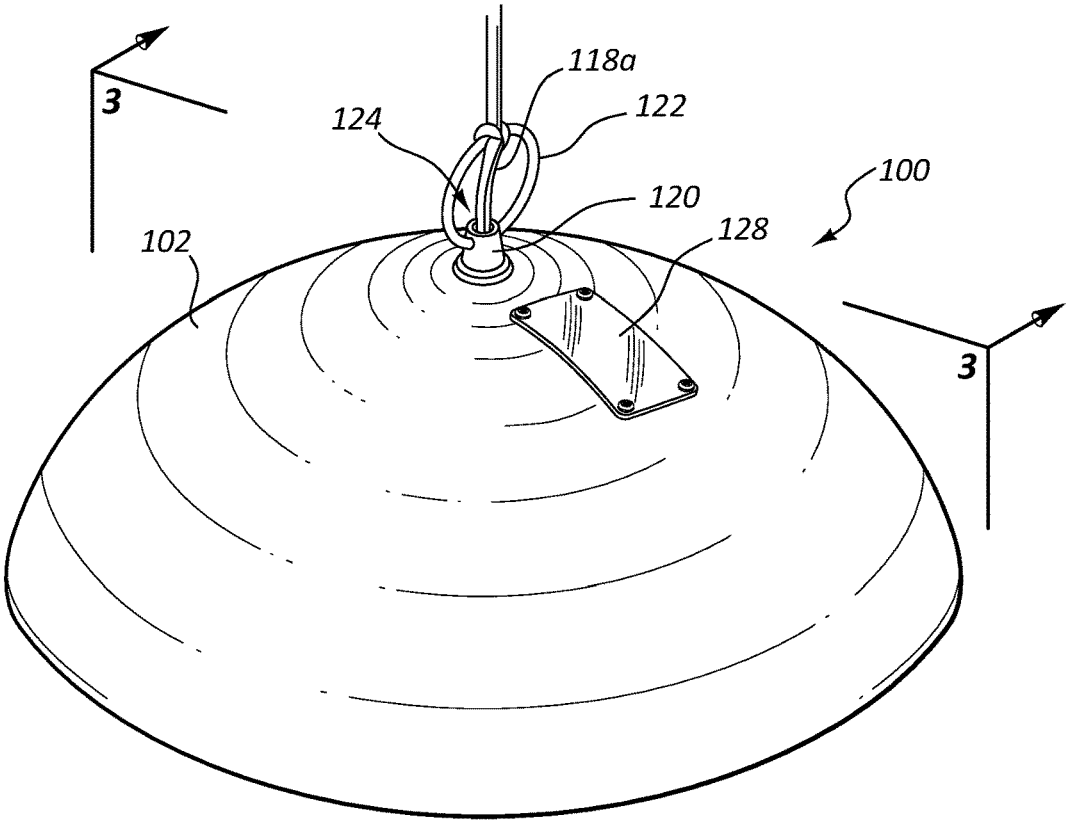
FIG. 1 is a top perspective view of an exemplary light fixture.
Figure 2:
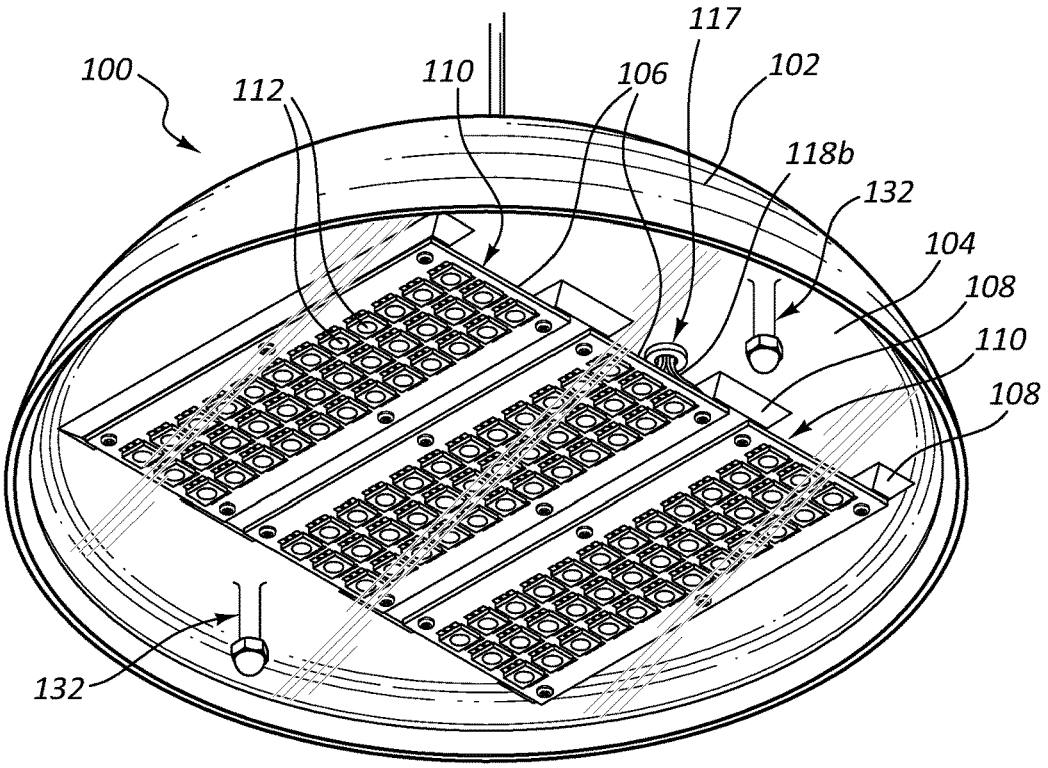
FIG. 2 is a bottom perspective view of the light fixture of FIG. 1.

Embodiments of the disclosure relate to light fixtures, particularly light fixtures in which a panel of the light fixture to which circuit boards including the light source (e.g., LEDs or other high efficiency light source) are mounted, wherein the panel comprises carbon fiber or other carbon material exhibiting a relatively high thermal conductivity. For example, carbon fiber may have thermal conductivity that varies depending on specific compositional, geometric (fiber size, orientation, etc.) and other characteristics, although in any such case, the carbon fiber may have a thermal conductivity of at least about 20 W/mK, at least about 50 W/mK, at least about 75 W/mK, or at least about 100 W/mK. Other forms of carbon having similarly high thermal conductivity could alternatively be used (e.g., amorphous carbon, graphene, or graphite). Other carbon containing materials (e.g., plastics such as polycarbonate or the like), while technically containing carbon, provide nowhere near such high values of thermal conductivity, nor do they provide similar resistance to corrosion of such materials that approach a composition consisting essentially of carbon (e.g., carbon fiber, amorphous carbon, graphene, or graphite). For example, carbon fiber is typically formed from a polyaromatic hydrocarbon (pitch resin), or polyacrylonitrile (PAN) processed carbon, and includes high fractions of carbon in the composition, as well as a typical aromatic or graphene ring structure.

While orientation of carbon fiber in a composite can affect the thermal conductivity (e.g., conduction can often be higher along the longitudinal axis of the fiber, and lower in directions transverse to the fiber orientation), there is sufficient thermal conductivity to such carbon fiber that fiber orientation may generally be unimportant in dissipating heat away from the heat generated by the LEDs on the circuit boards, the presently contemplated embodiments. Of course, specific orientations of the fibers may be provided, to increase thermal conductivity away from the circuit boards, or for other reasons (e.g., structural strength characteristics in the panel and/or the dome).

In addition to thermal conductivity benefits, the use of such forms of carbon within the panel is also advantageous as such forms of carbon are a relatively chemically inert, stable material under contemplated usage conditions. For example, as described above, in dairy barn and similar agricultural livestock operations, there is a significant and enduring concentration of reactive or corrosive components which degrade typical and existing lighting fixtures used in such environments. In addition to the methane ($CH_4$) present in such environments, there are also significant concentrations of sulfur containing corrosive compounds, and/or nitrogen containing corrosive compounds, which can react with and degrade the materials (such as metals and plastics) typically used in existing lighting fixtures. $H_2S$ is believed to be one such constituent present in at least some of the contemplated use environments. While the mechanisms relative to inertness and stability may not be fully understood, the inventor has found that the presently described light fixtures are advantageously resistant to the "rotting" and other degradation that routinely occurs in light fixtures employed in dairy barns and similar environments, so as to provide a very real benefit in that the light fixtures last far longer than the typical 2-3 years seen with existing alternatives. This can be particularly advantageous in livestock operations conducted in an enclosed building (e.g., with a roof and walls, even though some ventilation may be present), where such corrosive gases or other materials may tend to be present in elevated, chronic concentrations that lead to such rotting.

Similar advantages can be provided in other corrosive environments, e.g., including, but not limited to lighting along coastal highways, lighting along other coastal locations where airborne and other salinity levels are similarly elevated, sewage and municipal water treatment plants, enclosed agricultural production facilities other than dairy or other livestock barns (e.g., facilities for growing plants, where humidity and various salinity concentrations (e.g., calcium salts) are elevated. For example, "grow lights" are typically used for growth of such plants indoors, in a closed "close quarters" type environment, where humidity is typically elevated (e.g., greater than 50% relative humidity (RH), greater than 55%, greater than 60%, greater than 65%, greater than 70%, greater than 75%, greater than 80%, or greater than 85% RH, such as 55-99% RH, 60-99% RH, 80-99% RH, or the like). Time of wetness (TOW) in such an environment may approach, or be, 100% (e.g., every day within a year, RH is over 50%).

In addition, in such conditions, salts other than NaCl, such as calcium or other salts tend to build up deposits or "scale" on existing light fixtures. Such salts may similarly cause or exacerbate corrosion. Within any of such, or other similar corrosive environments, accelerated degradation of the fixtures and associated supporting structure continues to be a problem. Other environments where corrosion of existing lighting fixtures is accelerated will be apparent to those of skill in the art, in light of the present disclosure. For example, within any such environment, the carbon panel of the present light fixture may resist degradation from any of various corrosive components present in the corrosive environment, such that the light fixture has a useful life that is extended relative to what the useful life would be were the panel not comprised of carbon fiber. In may lighting applications, the light fixture may be supported on a support, e.g., such as a vertical or other oriented pole. Such poles are often formed from galvanized steel, which exhibits accelerated corrosion under environments such as those described herein (e.g., along a coastal highway). In an embodiment, additional benefit may be achieved by forming the pole or other support from carbon fiber or similar material, as well. Such a pole or other support would significantly reduce the weight of the resulting assembly (light fixture and support pole), while at the same time providing the support or any other component formed from carbon fiber or the like with increased degradation resistance.

II. Exemplary Light Fixtures

FIGS. 1-4 illustrate an exemplary light fixture 100 according to an embodiment of the present disclosure. Fixture 100 may include a dome member 102, a panel 104, and one or more circuit boards 106. As shown, panel 104 may include one or more raised portions 108, as well as one or more recessed portions 110 (recessed relative to the raised portion 108). Raised portions 110 allow mounting of circuit boards 106 thereto, while lifting circuit boards 106 off the remainder of the panel 104, effectively creating a gap between the panel 104 and the circuit board 106 at recesses 110. Such a gap or space provides for ventilative convective air flow through recess 110, which can aid in cooling boards 106 by convection cooling, as well as significant conductive cooling provided by thermal conduction from board 106 through raised portion 108, into the remainder of panel 104, and outwardly towards the periphery of the panel 104, and the dome member 102.

Such a configuration allows heat generated by LEDs 112 (or another high efficiency light source) to be drawn away from LEDs 112, into board 106, and then quickly and efficiently drawn from board 106 into raised portions 110, and then into the remainder of panel 104 as a result of the relatively high thermal conductivity provided by carbon fiber or similar carbon material from which panel 104 is fabricated. As described above, the panel may comprise a material, such as carbon fiber, having a thermal conductivity that is comparable to or greater than that provided by conventional metal materials from which a light fixture may otherwise be manufactured. For example, many steels have a thermal conductivity within a range of about 15 to about 30 W/mK. While perhaps sufficient to achieve at least minimally acceptable heat dissipation, such materials have been found to be subject to corrosion, in that light fixtures manufactured from such conventional materials often "rot" within a 2-3 year period, requiring their replacement. Plastic materials may also often be conventionally employed in manufacture of such light fixtures. Such materials typically exhibit even lower thermal conductivity (e.g., typically less than 1 W/mK), and are also subject to chemical and other (e.g., UV) degradation such as that described above.

The panel 104 may be fabricated from a carbon fiber material, or another form of carbon providing relatively high thermal conductivity, so as to advantageously provide for improved thermal conductivity, and corrosion/degradation resistance. Any suitable carbon fiber or other carbon material (e.g., amorphous carbon filled composite and the like) may be suitable for use. Carbon fiber may be particularly preferred, and can be integrated into a composite panel 104 through use of any suitable binding matrix material (e.g., epoxy resin, acrylic resin, other polymeric matrix materials, and the like).

Figure 3:
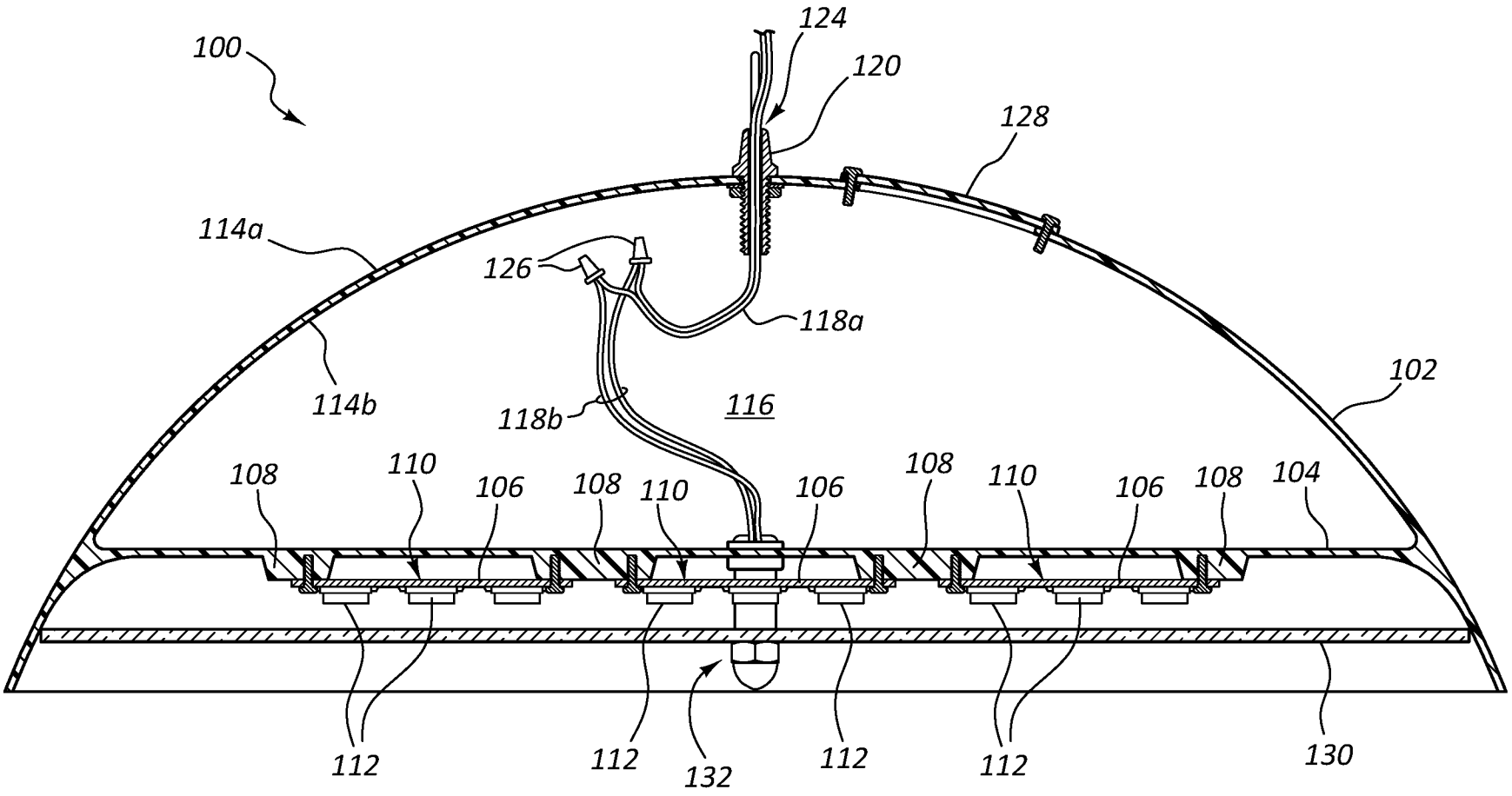
FIG. 3 is a cross-sectional view through the light fixture of FIG. 1.
Figure 4:
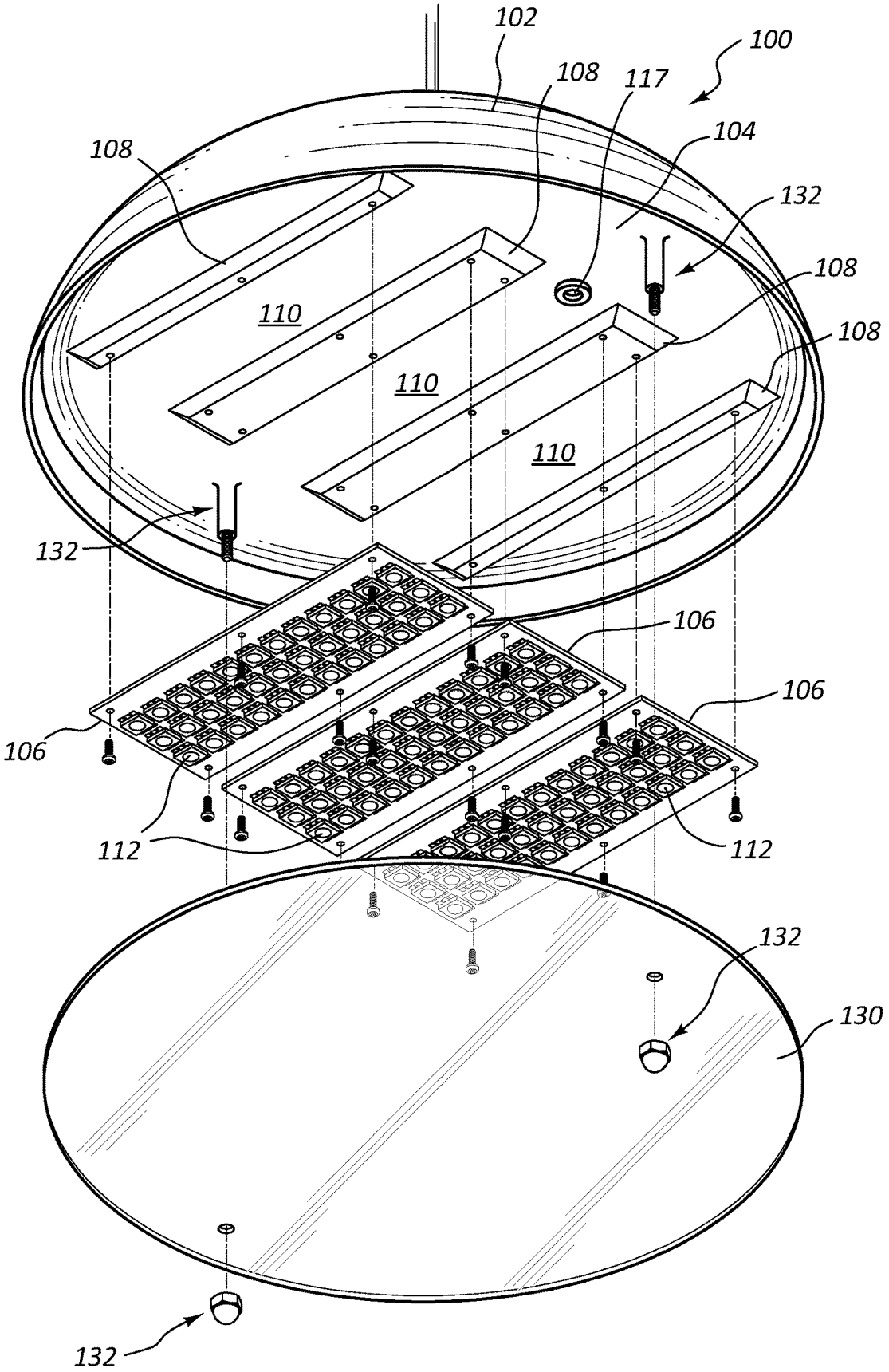
FIG. 4 is an exploded perspective view of the light fixture of FIG. 1, showing the dome member, panel to which the LED circuit boards are mounted, and the lens cover, separated from one another.
Figure 5:
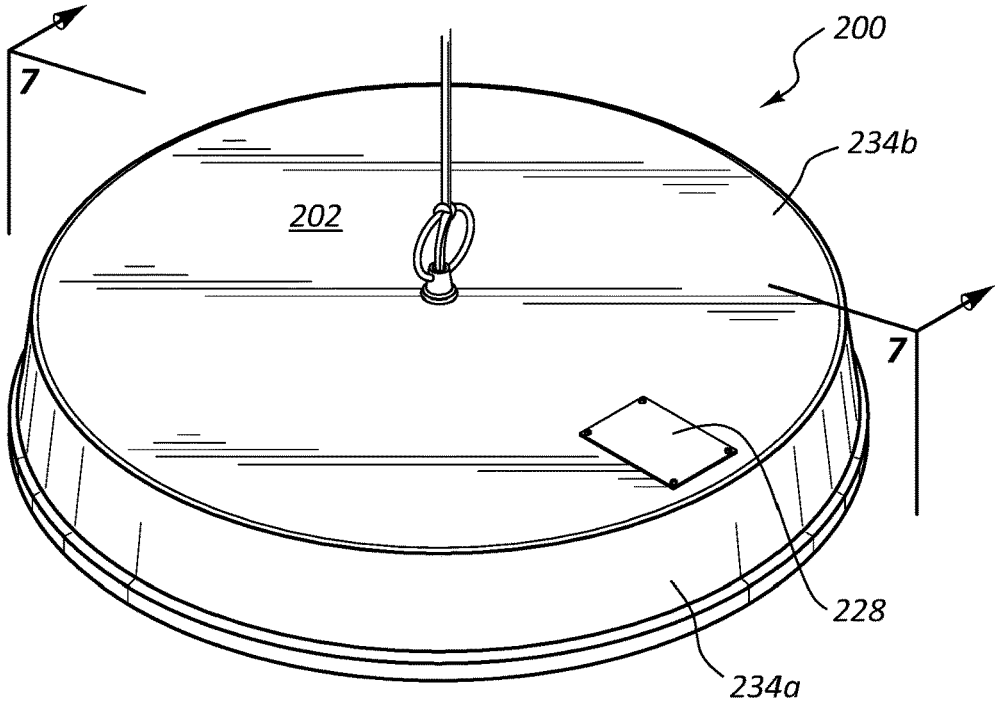
FIG. 5 is a top perspective view of another exemplary light fixture.
Figure 6:
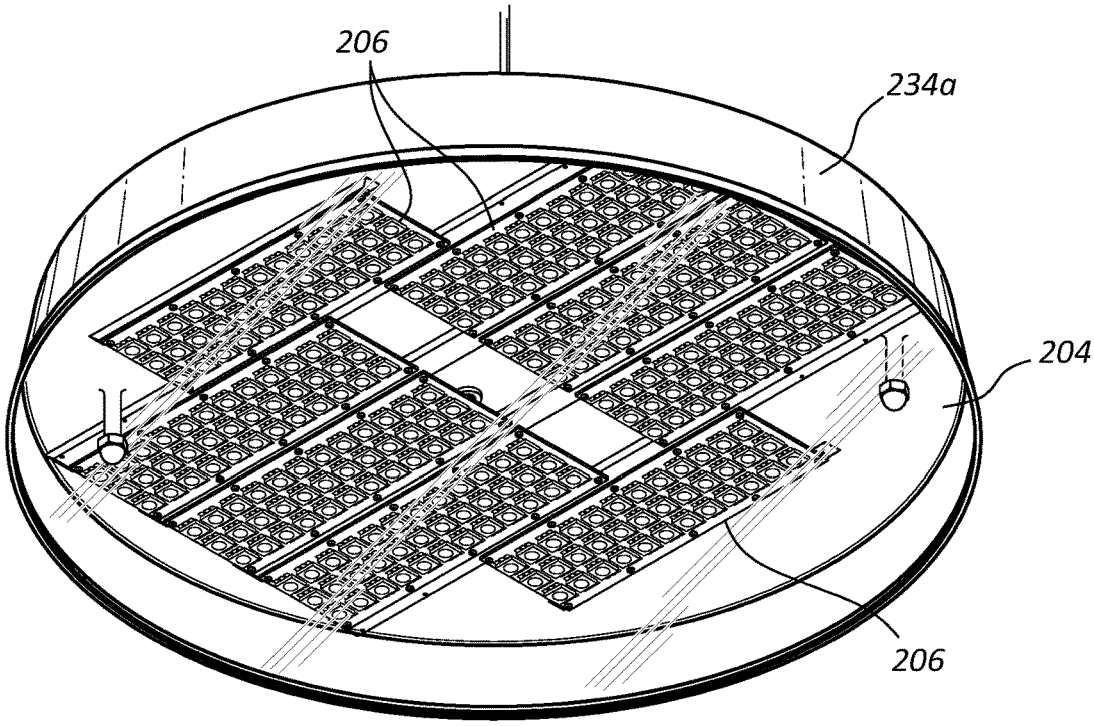
FIG. 6 is a bottom perspective view of the light fixture of FIG. 5.
Figure 7:
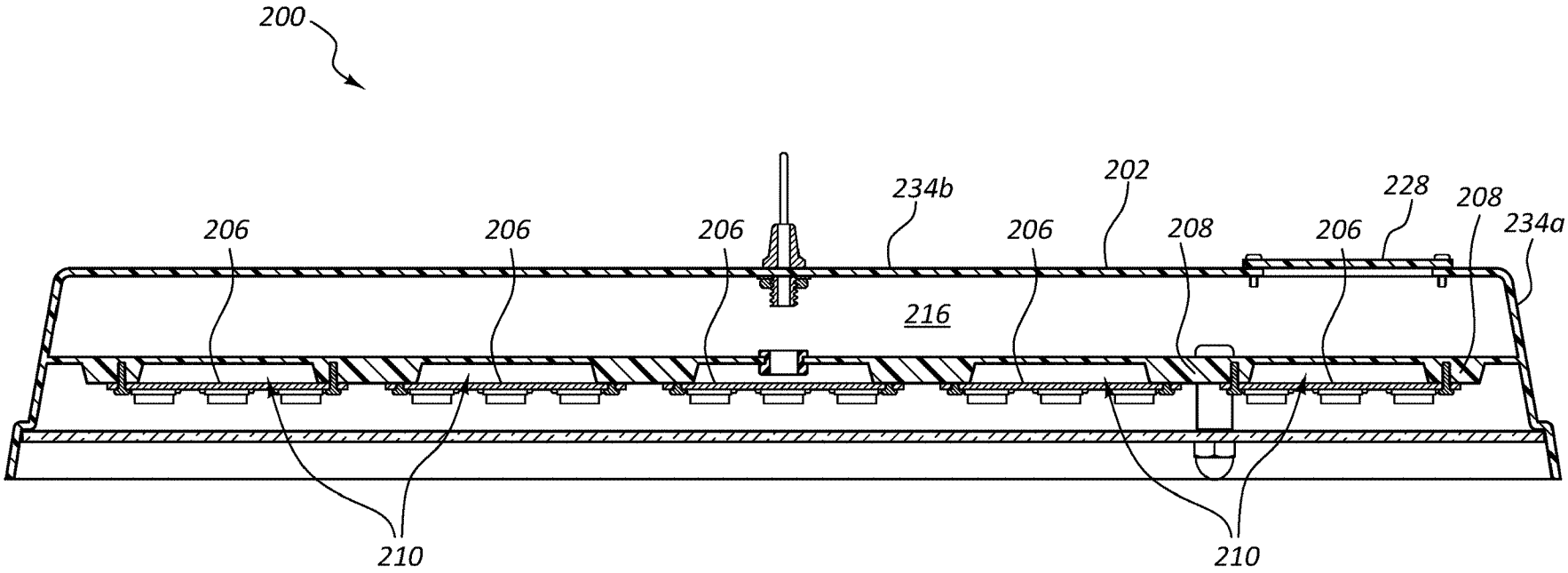
FIG. 7 is a cross-sectional view through the light fixture of FIG. 5.
Figure 8:
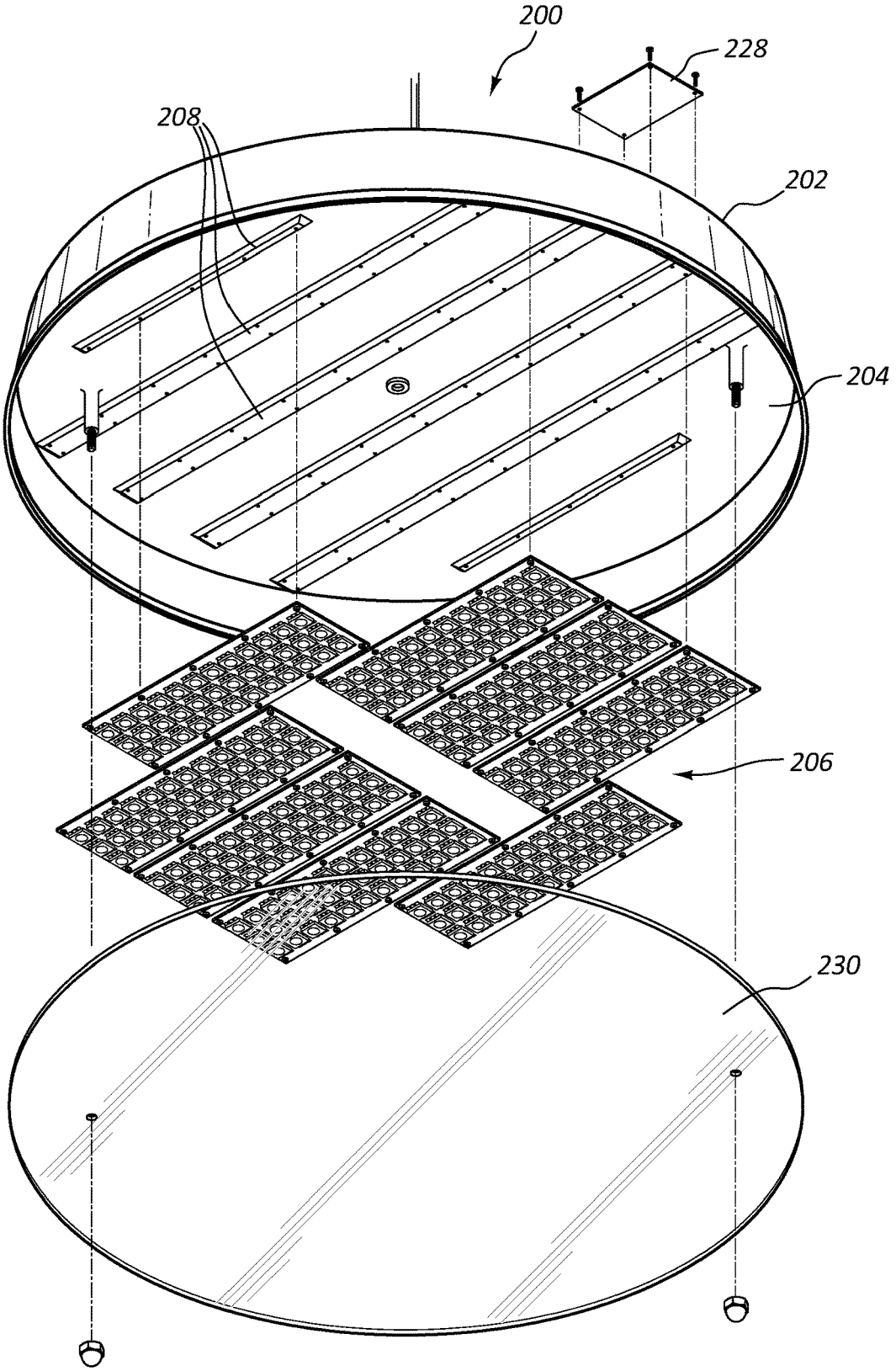
FIG. 8 is an exploded perspective view of the light fixture of FIG. 5.

As seen particularly well in FIGS. 1 and 3, the dome member 102 in an embodiment may be convexly curved. In the illustrated embodiment, the entire exterior surface 114*a* thereof may be so curved. The panel 104 may be attached or otherwise positioned adjacent the interior surface 114*b* of dome member 102. A space 116 meeting the standards for a sealed, UL (Underwriters Laboratories) electrical junction box may be provided between panel 104 and the interior surface 114*b* of dome member 102. Such a space provides the ability to easily make any electrical connections required within space 116, e.g., for electrically connecting electrical wiring 118*a* from the building where installed to wiring 118*b* of circuit boards 106. One or more wires 118*b* may be provided for distributing the electrical power from wiring 118*a* to each of the circuit boards 106 (and thus LEDs 112). The boards 106 may be connected as desired (e.g., in series). If desired, they could be wired in parallel.

As shown, a mounting fixture 120 for hanging or otherwise mounting the light fixture 100 may be provided (e.g., at the center of dome member 102). As shown, mounting fixture 120 may include a ring 122 and/or a hollow central passage 124 therethrough which allows passage of wiring 118*a* through dome member 102, into UL-approved space 116. Panel 104 may include a small hole 117 therethrough (e.g., about the width of the electrical wire 118*b*), allowing wiring 118*b* to pass through panel 104, into UL-approved space 116. Within space 116, an electrical connection (e.g., using wire nuts 126 or other suitable connector) may be completed between wiring 118*a* and 118*b*.

In order to facilitate easier electrical connection of wire 118*a* with wire 118*b* within space 116, an access door 128 may be provided through dome member 102, for accessing space 116. Door 128 may be secured to dome member 102 by any suitable mechanism, e.g., including screws or the like. In an embodiment, door 128 may snap into place over the opening (e.g., much like a battery compartment door). Such a mechanism may be more easily removed and replaced, as needed. Any suitable mechanism that does not compromise the UL-approved status of the space 116 may be used.

Such an access opening and door 128 may be significantly larger than opening 124 into space 116, so as to allow a person to reach into space 116 and pull wires 118*a* and 118*b* out, make the electrical connection, and then push connected wires 118*a* and 118*b* back into space 116, through the opening covered by door 128. For example, such an opening may have an area of about 5 $in^2$ about 20 $in^2$, or about 6 $in^2$ to about 15 $in^2$ (e.g., 2×3 inches, or 3×5 inches). While being sufficiently large to allow a person to reach into space 116 and retrieve wires 118*a*, 118*b*, and reinsert them after wire nutting or otherwise connecting them together, the opening may be sufficiently small so as to still maintain UL-approval for space 116.

As perhaps best seen in FIG. 3, a lens cover 130 may be provided over panel 104 (e.g., with panel 104 between lens cover 130 and dome member 102). Such a lens cover may be transparent, allowing light generated by LEDs 112 to pass therethrough, illuminating the building or other environment where the fixture is to be placed, while providing protection to the underlying LEDs 112 and circuit boards 106. Lens cover 130 may comprise any suitable material, including glass or plastic. Plastics may be preferred as being more durable if the fixture is dropped or bumped. Suitable materials may include, but are not limited to polycarbonate, acrylics, and the like. In the illustrated configuration, the lens 130 is shown held in place by nuts and associated screws at 132. It will be appreciated that other mounting mechanisms may also be employed. For example, a groove may be provided within the interior surface 114*b* of dome member 102, into which lens cover 130 may be seated.

While at least panel 104 comprises carbon (e.g., carbon fiber), the dome member 102 may also be formed of a similar material, e.g., carbon fiber in a suitable matrix material, such as epoxy resin, acrylic resin, or the like), providing excellent thermal conductivity and degradation resistance characteristics thereto as well. Where the dome member 102 and panel 104 comprise carbon (e.g., carbon fiber), this results in a light fixture 100 that is particularly durable, resistant to degradation in spite of the atmospheric chemistry within the particular environment in which it is employed, and which provides excellent heat dissipation away from the LEDs 112. For example, such a light fixture may be employed in a dairy barn or similar environment where there are relatively high (and chronic) levels of hydrogen sulfide, methane, and other constituents generated from the cattle or other animals. Such chemicals have been found to "rot" existing and typically employed light fixtures that are currently used in such facilities. Such conditions result in a need to replace lighting fixtures after only 2-3 years of use. The present light fixtures are far more resistant to degradation, and may typically last at least 5 years, at least 7 years, at least 8 years, or at least 10 years, at least 15 years, at least 20 years, at least 25 years, or at least 30 years. Such fixtures may last 10-20 years, or 10-30 years, without need for replacement, under conditions where typical light fixtures "rot" after only 2-3 years, and require replacement.

One other nuisance associated with such agricultural installations is that in addition to the chemicals generated and emitted by the cattle or other animals being raised, there are often pigeons or other birds who tend to nest in or perch on the existing, typically employed light fixtures. As a result of such nesting, perching, or loitering, the light fixtures also typically become covered and encrusted with the guano of such birds. Such encrustation often further exacerbates the "rotting" problem, as there are corrosive (e.g., saline and other) components within such guano, which remains long term in contact with the light fixtures.

As shown in FIGS. 1 and 3, in an embodiment, the dome member 102 may be convexly curved over its entire surface. For example, in an embodiment, the dome member may be generally hemispherical in shape, as shown. Such a shape does not include any flat exterior surfaces, but is curved over its entire exterior surface, with a curvature having a relatively tight radius of curvature. For example, the radius of curvature may be not more than about 24 inches, not more than about 20 inches, not more than about 15 inches, or not more than about 10 inches. Such a highly curved exterior surface 114*a* makes it difficult for birds to stand on the dome member 102, so that instead of nesting, perching and/or loitering thereon, they tend to avoid the fixture 100 altogether. Such a shape is advantageous in preventing birds from nesting or loitering on the light fixture.

FIGS. 5-8 illustrate another light fixture 200 similar to fixture 100, but with several different features. Any of the features described herein with respect to light fixture 100 may be provided within fixture 200, and vice versa. Light fixture 200 similarly includes a dome member 202, a panel 204, and circuit boards 206 with LEDs 212. A lens cover 230 may similar be provided, covering circuit boards 206 and LEDs 212. Panel 204 may similarly comprise a carbon material, such as carbon fiber, to provide the ability to quickly and efficiently conduct heat away from circuit boards 206. Panel 204 may similarly include raised portions 208 with recessed portions 210 disposed therebetween, providing an air gap associated with recessed portions 210, between panel 204 and circuit boards 206. Light fixture 200 is shown as being larger in size, accommodating 8 LED circuit boards 206, while light fixture 100 is shown as including 3. Of course, any number may be provided. In addition, the circuit boards could be any conceivable shape or size (e.g., rectangular, triangular, hexagonal, other polygon, circular, or the like). The placement, spacing and other characteristics of the raised portions and recessed portions can similarly be adjusted to accommodate whatever particular geometry of circuit boards are being used. A UL-approved space 216 is similarly provided between dome member 202 and panel 204, with access provided thereto through access door 228 and an opening in dome member 202 that is covered by door 228.

Dome member 202 differs from dome member 102 in that it includes an exterior surface that is downwardly curved or sloped at an edge portion 234*a*, and which includes a central portion 234*b* that is substantially flat. Such a light fixture could be installed in a dairy barn or other desired environment as is (e.g., similar to fixture 100), but the differently shaped dome member 202 also provides the ability to retrofit light fixture 200 into an existing light fixture. For example, it may be particularly advantageous to retrofit fixture 200 into a bell-shaped light fixture such as those that are legacy light fixtures, installed in arenas, gymnasiums, and other similar large volume indoor facilities. Such bell-shaped legacy fixtures do not typically include an LED light source, but rather a lower efficiency, older technology light source such as incandescent, halogen, fluorescent, sodium vapor, or the like. It may be particularly desirable to upgrade such existing legacy light fixtures with a high efficiency LED light source. The light fixture 200 is particularly suited to such a purpose.

Figure 9A:
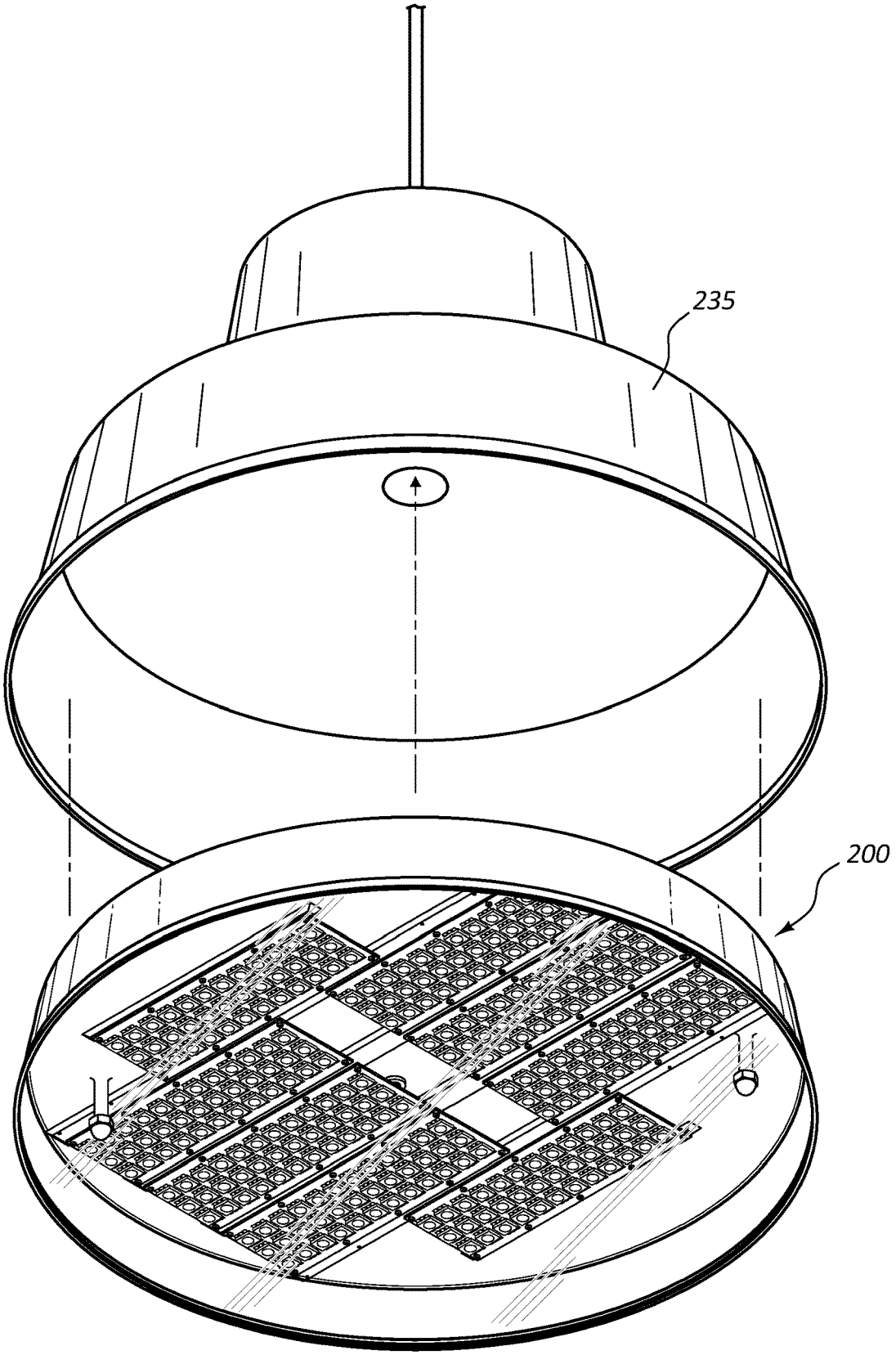
FIG. 9A is an exploded perspective view showing how the light fixture of FIG. 5 may be retrofitted into an existing bell shaped light fixture housing.
Figure 9B:
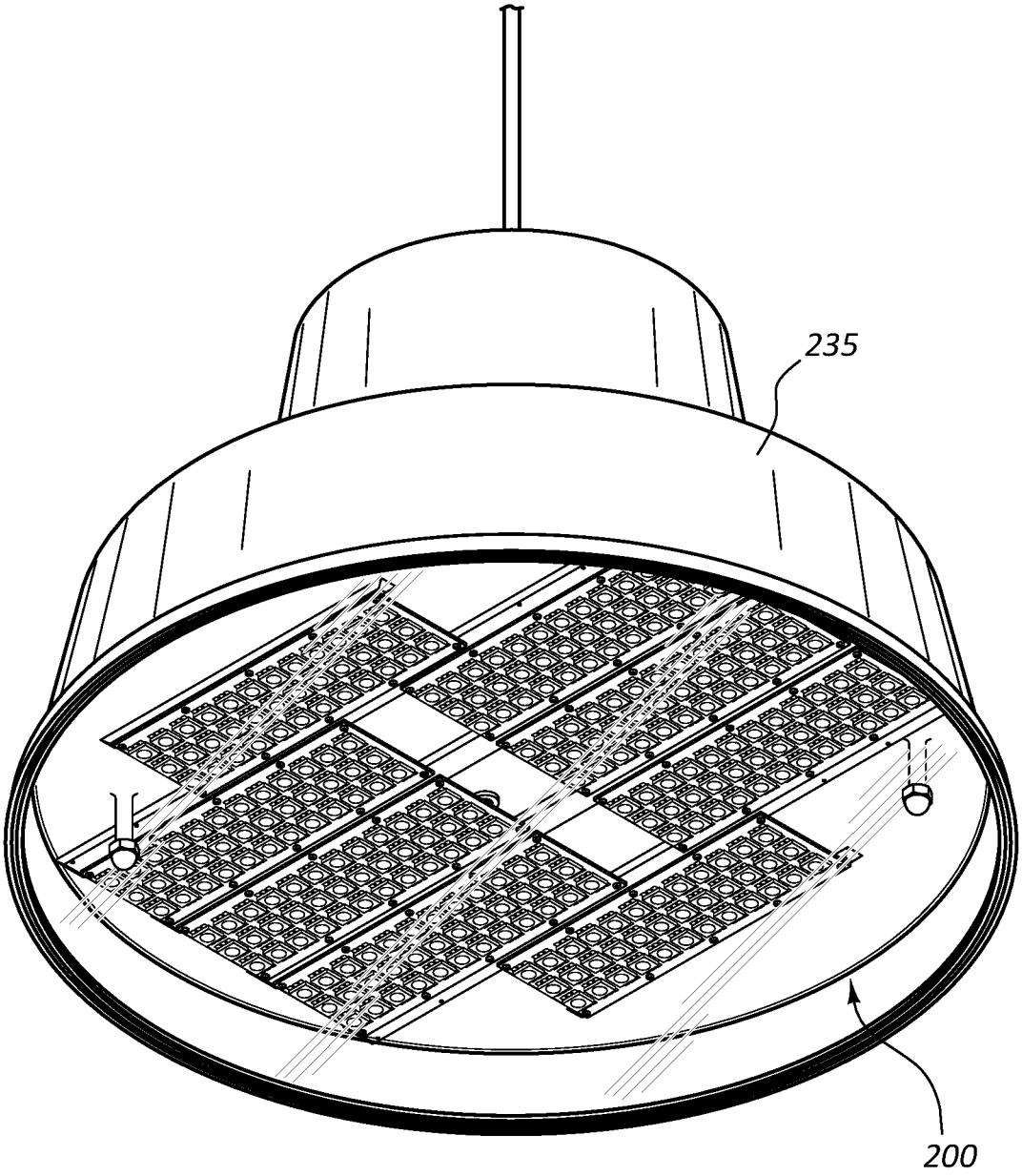
FIG. 9B is an assembled view similar to that of FIG. 9A, but showing the light fixture retrofitted into the bell shaped housing.

FIGS. 9A-9B illustrate how once the old light source has been removed from the legacy, existing bell-shaped housing 235, light fixture 200 may be inserted into the void within the bell-shaped housing, filling the space previously occupied by the old light source. Electrical wiring may be run through the existing bell-shaped housing 235, through dome member 202, into space 216, where such wiring can be electrically connected to the wiring (e.g., analogous to wire 118*b* of fixture 100) of fixture 200.

Figure 10A:
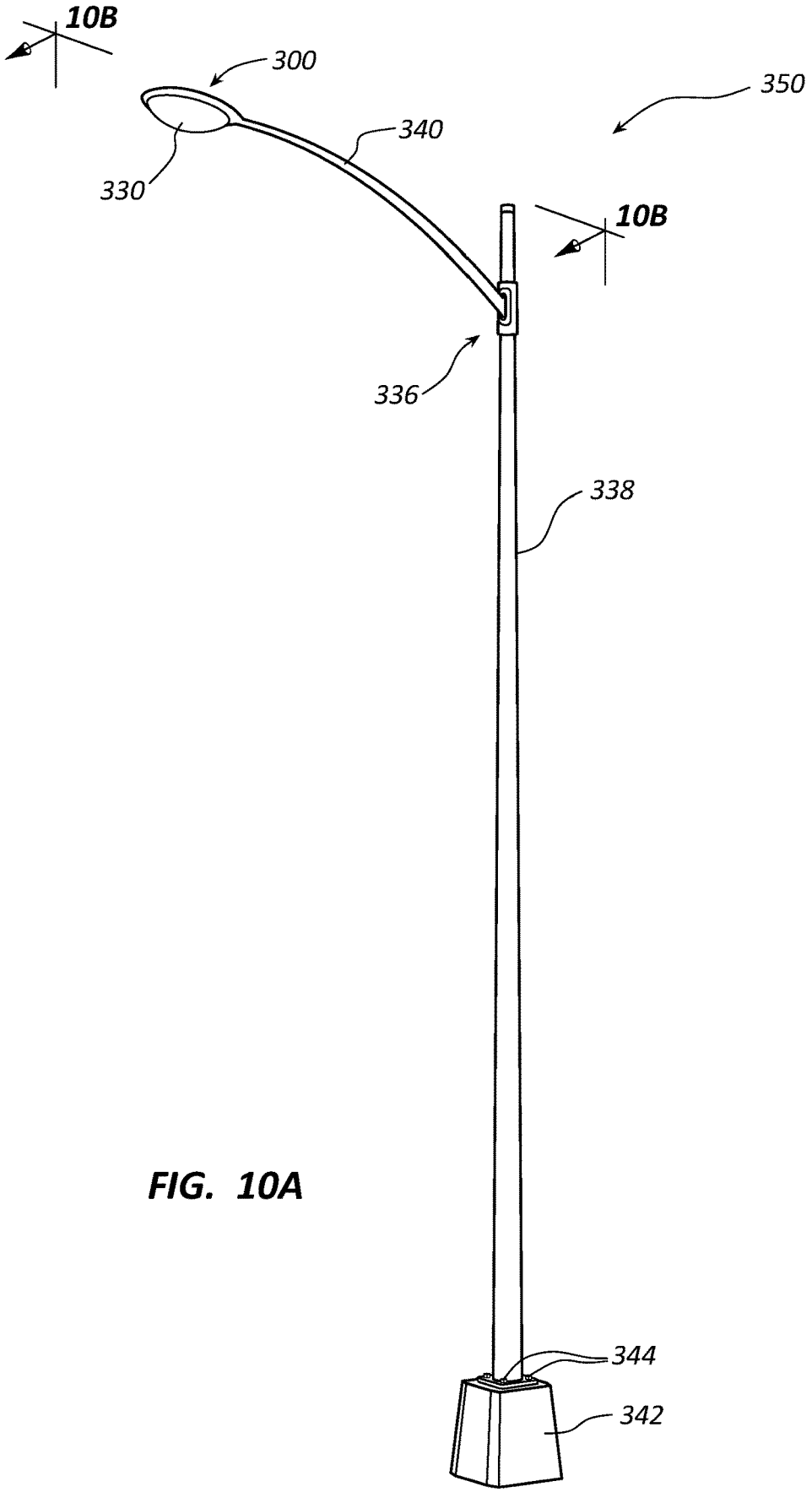
FIG. 10A is a perspective view of an exemplary light fixture and associated support pole typically used in highway lighting, municipal lighting, and the like, which may incorporate features of the present invention.
Figure 10B:
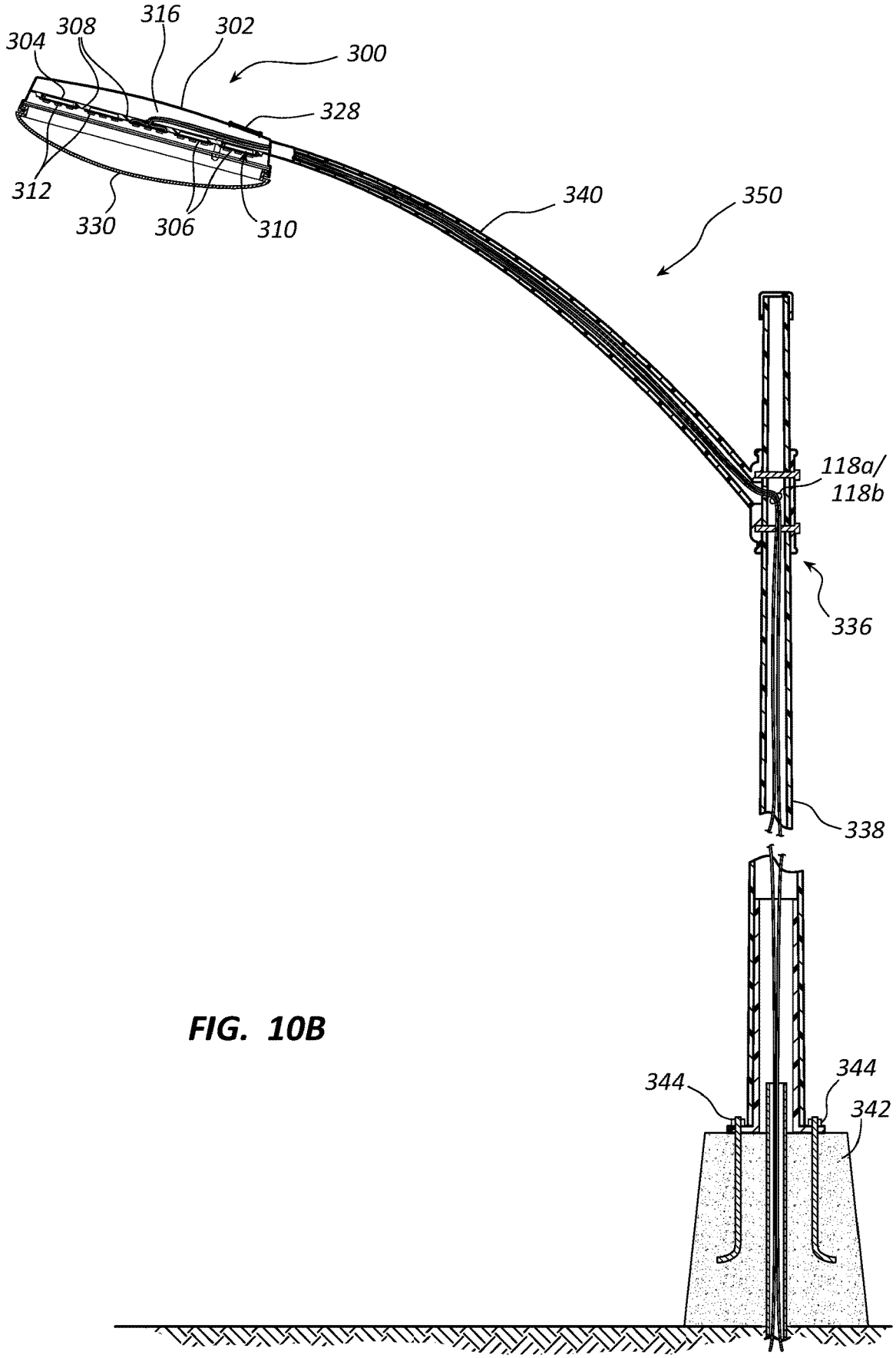
FIG. 10B is a cross-sectional view through the light fixture and associated support of FIG. 10A.

FIGS. 10A-10B illustrate another light fixture assembly 350 that may incorporate features as described herein. For example, the assembly 350 is shown as including a support 336, as well as a light fixture 300, that may otherwise be similar to those described previously, e.g., including a dome member 302, a panel 304, raised portions 308, recessed portions 310, LEDs 312, space 316, access door 328, and lens cover 330. Electrical connection to fixture 300 may be made up through support 336, as shown. Support 336 may include a vertical or other oriented pole member, e.g., 338. Support 336 is also shown as including a cantilevered arm 340 extending from vertical pole 338, to which light fixture 300 is mounted, e.g., providing lighting to a highway, parking lot, industrial facility (e.g., sewage or water treatment plant), or other location below. In the illustrated embodiment, vertical pole 338 is secured to a concrete or similar anchor 342. Bolts, rebar, or the like 344 may be used to attach (e.g., permanently) the two structures together. In an embodiment, any components that are exteriorly exposed (e.g., not encased in concrete) may be non-metallic, e.g., also comprising carbon fiber, as such material is significantly more resistant to degradation that galvanized steel, or other routinely used materials. For example, the pole 338 and/or arm 340 may comprise such a carbon fiber material, in addition to those components of the light fixture that may comprise such materials. In an embodiment, the support assembly 336 (including pole 338 and/or arm 340) may be substantially devoid of steel or other metallic materials that are susceptible to corrosion, particularly in environments as described herein. In an embodiment, the pole 338 and/or arm 340 may be formed from a composite material of carbon fiber and fiberglass, embedded in a matrix material (e.g., any of the matrix materials described herein, such as epoxy, acrylic, other resin matrix material, etc.).

By forming the support 336 from such materials, the support exhibits less tendency to degrade in corrosive environments such as those described herein. For example, methane, $H_2S$ and other corrosive constituents in sewage treatment or other water treatment plants can cause conventional steel components to quickly degrade in such conditions. Environments near large sources of salt water (e.g., coastal highways or the like) exhibit similarly corrosive environments, relative to conventional steel components for lighting installations. Use of the carbon fiber materials as disclosed herein would significantly increase the lifespan of such lighting components, due to their resistance to corrosion in such environments. For example, at least with respect to coastal environments, deposition rates of NaCl increases exponentially with proximity to the beach or other coastline. For example, in a more typical inland environment, deposition rates for NaCl may be no more than 10, no more than 5, or no more than 3 $mg/m^2/day$. In a coastal environment (e.g., within 10 miles, within 5 miles, within 3 miles, or within 1 mile of the coast), the rate of deposition may be significantly higher, e.g., such as greater than 50, greater than 60, greater than 75, or greater than 100 $mg/m^2/day$. By way of further example, a typical deposition rate within 200 m of the coast may be from 300 to 1500 $mg/m^2/day$. It will be readily apparent that such concentrations of NaCl and elevated concentrations of other salts present in such a coastal environment, coupled with elevated humidity (e.g., elevated "time of wetness" (TOW) can result in significantly accelerated corrosion of lighting components in such environments. In an embodiment, TOW may be determined based on days per year (e.g., percentage out of 365 days) that relative humidity exceeds 50%. In many coastal environments, such a TOW value may be more than 40%, more than 50%, more than 60%, more than 70%, more than 80%, or even more than 90% of the days in a year. Under such elevated humidity levels, and where there is significant salinity in the atmosphere, corrosion of conventional metallic (e.g., particularly steel, even galvanized steel) is significantly accelerated. Use of the presently described systems would significantly increase the useful lifespan of such lighting components (e.g., light fixtures and supports).

An additional benefit of the presently described systems is decreased weight. For example, a typical galvanized steel lighting installation (fixture and support) easily weighs at least 800 lbs (e.g., 800 to 1000 lbs). While aluminum can sometimes be used in such environments, and is less heavy, it is significantly more expensive, and may still exhibit some level of corrosion problems. A lighting installation similarly sized to the above, but formed from carbon fiber (or a composite of carbon fiber and fiberglass in a suitable resin matrix) may weigh only about 10% that of existing conventional systems (e.g., 80-100 lbs). Some smaller "serpentine head" exterior lighting installations may weigh somewhat less, e.g., 200 to 400 lbs, although the same size fixture (same size and shape) could be formed using principles described herein, again, at about 10-20% of the conventional weight, e.g., from 40-80 lbs. Where conventional installations fall on a car or other vehicle, they cause massive damage, which can be life threatening to occupants of the vehicle. Use of the presently described systems would significantly reduce safety risks, where such a lighting installation may fall onto a vehicle (e.g., in a crash or the like). For example, typical poles are engineered to shear off bolts 344 if hit by a car or other vehicle. While the pole or other support 336 may thus still fall on the car or other vehicle, toppling of a 100 lb or lighter assembly (light fixture, and support) is far less damaging and dangerous than toppling of an 800 lb similarly dimensioned assembly.

As conventional fixtures typically rot out after 10-15 years or less (sometimes far less, such as 5 years, or 3 years) under conditions as described herein, they could be replaced (e.g., retrofitted) with systems as described herein, which would last significantly longer. Maintenance may also be reduced, e.g., as where 10-15 years of life may currently be possible with frequent sandblasting and resealing (e.g., galvanizing, painting, etc.) of the conventional steel materials, the present systems would provide even longer lifespan, with reduced maintenance requirements.

While the issue of corrosion is described in the context of coastal areas, where airborne salinity is elevated, such conditions may also exist in other conditions, e.g., in winter, where roads are heavily salted. Installation as described herein would reduce corrosion throughout the entire structure (e.g., support pole, arm, any other support components, light fixture, etc.), particularly at the base of such installations, where salt from road salting may be particularly concentrated.

Even where a composite of carbon fiber and fiberglass may be used for the fibrous portion of the composite used to produce such pole or other support components, the majority of the fibers employed may be carbon fiber, as carbon fiber is generally stronger than fiberglass. Such composite materials may also readily be colored (e.g., by incorporating a dye or pigment into the matrix material. For example, the lighting fixture installation could be colored to coordinate for a school or other institution's official colors, or the like.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

The invention claimed is:

1. A method of providing degradation-resistant light fixtures in a corrosive environment, the method comprising:

providing one or more LED light fixtures in the corrosive environment, each light fixture comprising:

a dome member including an exterior surface and an interior surface; and a panel attached to the interior surface of the dome member, wherein the panel comprises carbon fiber;

the panel including raised portions and recessed portions between adjacent raised portions, the raised portions including a mounting surface;

at least one circuit board mounted to the mounting surfaces so that the circuit board spans between the adjacent raised portions of the panel, the at least one circuit board including one or more LEDs;

wherein the carbon panel of the light fixture resists degradation from corrosive components present in the corrosive environment such that the light fixture has a useful life that is extended relative to what the useful life would be were the panel not comprised of carbon fiber.

2. The method as recited in claim 1, wherein both the dome member and the panel both comprise carbon fiber.

3. The method as recited in claim 1, wherein the corrosive environment is a coastal highway, sewage treatment plant, municipal water treatment plant, or an enclosed agricultural production facility.

4. The method as recited in claim 1, wherein the method further comprises mounting or providing the light fixture mounted on a pole support, wherein the pole support of the light fixture also comprises carbon fiber.

5. The method as recited in claim 4, wherein the pole support is formed from a composite comprising the carbon fiber and fiberglass, in a matrix material.

6. The method as recited in claim 5, wherein the matrix material comprises an epoxy or other resin or polymeric matrix material within which the carbon fiber and fiberglass materials are embedded.

7. A lightweight degradation resistant light fixture and associated support, comprising:

a light fixture comprising:

a dome member including an exterior surface and an interior surface; and a panel positioned adjacent to the interior surface of the dome member, wherein the panel is formed from carbon fiber;

wherein the panel includes raised and recessed portions, the raised portions providing a mounting surface for mounting a circuit board of an LED light source thereto;

a support comprising a vertical pole on which the light fixture is supported, wherein the vertical pole of the support also comprises carbon fiber.

8. The light fixture and support as recited in claim 7, further comprising:

a lens cover disposed over the panel to protect one or more circuit boards mounted to the panel;

a space between the interior surface of the dome member and the panel; and an access door through the exterior surface of the dome member for accessing the space between the dome member and the panel.

9. The light fixture and support as recited in claim 7, wherein both the dome member and the panel are formed from carbon fiber.

10. The light fixture and support as recited in claim 7, wherein the vertical pole is formed from a composite of the carbon fiber, fiberglass, and a matrix material.

11. The light fixture and support as recited in claim 10, wherein the matrix material comprises epoxy or another resin material, or a polymeric matrix material.

* * * * *